United States Patent [19]

Hickey et al.

[11] Patent Number: 4,586,421

[45] Date of Patent: May 6, 1986

[54] UNDERWATER WEAPON SYSTEMS

[75] Inventors: Christopher D. D. Hickey, Haywards Heath; Bernhard D. Parker, Morden, both of United Kingdom

[73] Assignee: Underwater Storage Limited, Sussex, United Kingdom

[21] Appl. No.: 546,196

[22] Filed: Oct. 27, 1983

[30] Foreign Application Priority Data

Oct. 28, 1982 [GB] United Kingdom ..... 8230843
Dec. 10, 1982 [GB] United Kingdom ..... 8235284

[51] Int. Cl.[4] ..... F41F 3/042; F41F 3/07
[52] U.S. Cl. ..... 89/1.810; 102/411
[58] Field of Search ..... 89/1.810, 1.809; 102/411, 412; 175/67

[56] References Cited

U.S. PATENT DOCUMENTS 1,853,379 4/1932 Rotinoff ..... 175/67 X
2,931,187 4/1960 Perkins ..... 175/67 X
3,072,022 1/1963 Wood et al. ..... 89/1.810 X
3,137,203 6/1964 Brown ..... 89/1.810
3,158,062 11/1964 Feiler ..... 89/1.810
3,279,319 10/1966 Semonian et al. ..... 89/1.810
3,301,132 1/1967 Lehmann et al. ..... 89/1.810
3,499,364 3/1970 D'Ooge ..... 89/1.810
3,916,634 11/1975 Woodruff ..... 175/67 X
4,274,333 6/1981 Lampton ..... 102/411 X
4,395,952 8/1983 Hickey ..... 89/1.810

*Primary Examiner*—David H. Brown
*Attorney, Agent, or Firm*—Young & Thompson

[57] ABSTRACT

An underwater weapon system comprises an elongate outer container which is buried or partially buried in the sea bed in an upright position using devices at the bottom end of the container and which preferably comprise both a pump for removing sand or silt and an auger for boring a hole in the sea bed or a rotary stirrer. The weapon is a self-propelled device with guidance and is housed within an inner container which is telescopically arranged within the outer container.

9 Claims, 2 Drawing Figures

32
33
29
31
30
SECOND SENSOR
39
CONTROL SYSTEM
36
13
10
11
12
28
14
PRESSURIZED GAS CONTAINER
35
26
BATTERIES
26
24
23
22
20
50
16
FIRST SENSOR
38
27
21
25
21a
25

UNDERWATER WEAPON SYSTEMS

BACKGROUND OF THE INVENTION

1. Field of the Invention

This invention relates to underwater weapon systems.

2. Prior Art

As is described above in U.S. Pat. No. 4,395,952 of C. D. D. Hickey, an underwater weapon system may comprise a container adapted for burying or partially burying in a sea bed and a self-propelled weapon which is released from the container when required for use.

SUMMARY OF THE INVENTION

The present invention is concerned more particularly with improvements to such a weapon system.

According to one aspect of the present invention an underwater weapon system comprises a self-propelled weapon, a watertight container for the weapon, means in or in the container for burying or partially burying the container in the sea bed and ejection means within the container for expelling the weapon from the container. Conveniently the ejection means comprises gas operated means. This may use pressurised gas, e.g. from a pressurised or liquefied gas store or from chemical generating means, e.g. an explosive device.

By providing ejection means in the container, it becomes possible to eject the weapon from the container through silt or sand over the container. After the weapon has been ejected or partially ejected, the self-propulsion means on the weapon can operate to propel the weapon in its further functioning.

Conveniently the weapon is within or partially within an inner container and the aformentioned ejection means is arranged to operate on the inner container to expel or partially expel it from the aforementioned watertight container, i.e. the outer container. In some cases, however, it may be preferred to propel the inner container out of or partially out of the outer container by hydrostatic injection, e.g. using a pump.

In one convenient arrangement, the outer container is of generally elongate form and the weapon is within an inner container which is ejected through one end of the outer container by said ejection means.

The containers would in this case conveniently be of elongate form, for example of generally cylindrical form, and may conveniently be buried or partially buried in the sea bed with the container axes in a generally upright direction.

Thus according to another aspect of the present invention an underwater weapon system comprises a self-propelled weapon, an outer elongate watertight container with means for self burial in the sea bed in a generally upright position and ejection means arranged for ejecting the weapon out of the container through one end thereof. As previously indicated, the ejection means may be gas operated means utilising gas from a pressurised gas or liquefied gas store or from a chemical generating means, e.g. an explosive device. An inner container may be arranged between the weapon and the ejection means to form, in effect, a piston sliding in the outer container when the ejection means operate.

Means may be provided in the outer container to retain the inner container after partial ejection allowing the weapon to continue outwardly from the containers or the inner container may be arranged to part from the weapon system after leaving the outer container.

The means for burying the container may comprise pump means for displacing sand or silt from under the container. Alternatively or additionally rotary material displacing means may be provided. These rotary material displacing means may be means, e.g. an auger or augers, for making a hole in the sea bed or may be means for loosening or breaking up the sea bed so that the material thereof can be washed or pumped away, for example using a water jet to force material away from under the weapon or a pump to pump the material away, e.g. by raising upwardly through a passage or duct extending through the container.

Self-propelled weapons such as might be used underwater are generally of elongate form and hence the container would conveniently also be of elongate form. Such a container may be lowered or dropped vertically on to the sea bed and, in this case, the rotary material displacing means may comprise an auger, or augers, on one end of the container and operable to bore downwardly into the sea bed to form a hole into which the container enters. Means may be provided for automatically initiating operation of the rotary material displacing means or other self-burying means when the container reaches the sea bed. Means may also be provided for automatically stopping operation of the rotary material displacing means after a predetermined time or after the container has entered a sufficient distance into the sea bed or under the control of sensor means provided to determine when the container is sufficiently buried. With a vertically disposed container, it may be convenient to use a rotary device to loosen or break-up the sea bed material beneath the end of the container and to pump this material upwardly through the container to a discharge aperture or apertures. Fins may be provided on the container adapted to enter the sea bed to prevent or reduce rotation of the container; such fins or the like will generally be necessary if a single auger or other rotary device is used at one end of a vertical container.

DESCRIPTION OF THE PREFERRED EMBODIMENTS

Figure 1:
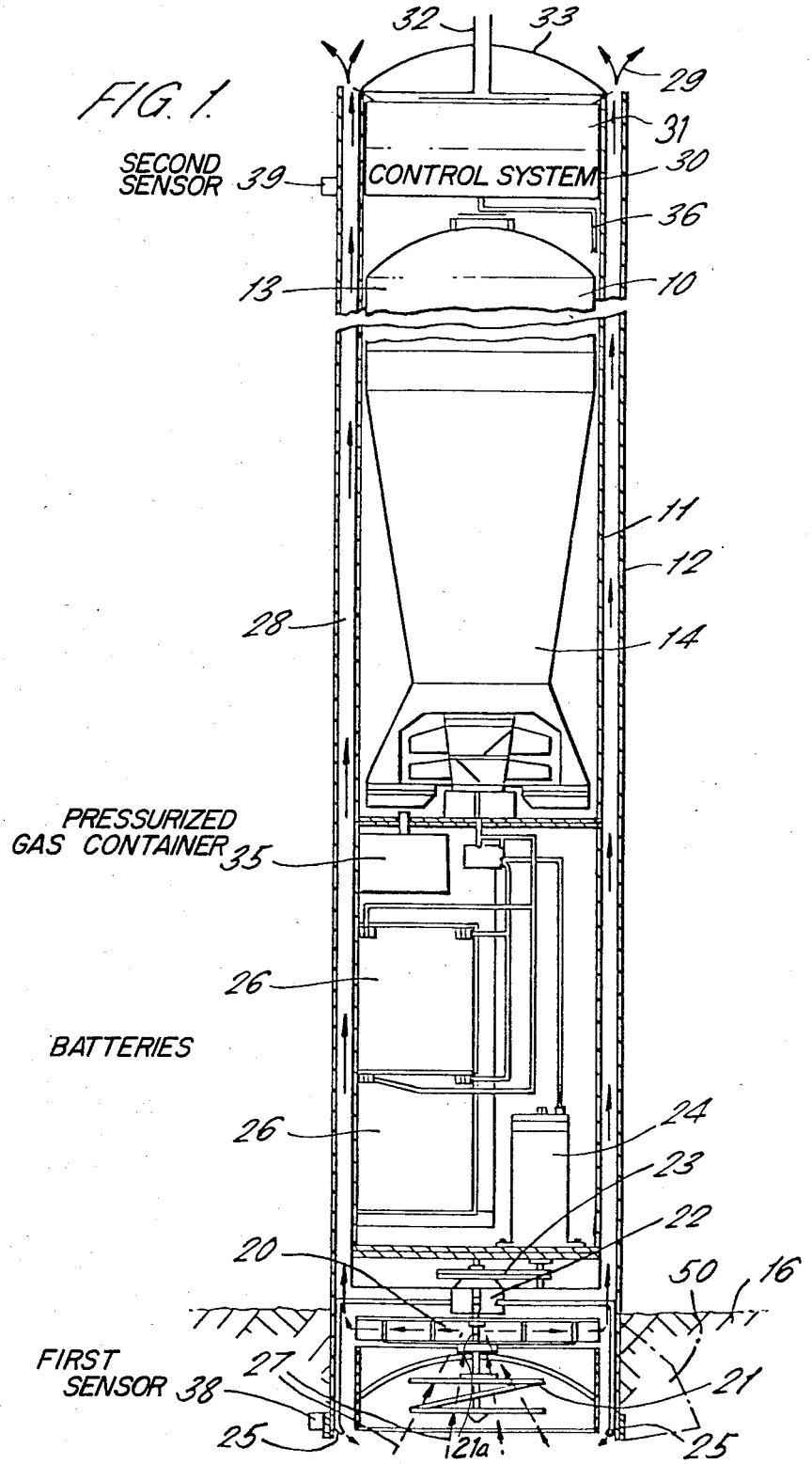
FIG. 1 is a diagrammatic sectional elevation illustrating one embodiment of an underwater weapon system partly buried in the sea bed.

Referring to FIG. 1, a self-propelled underwater-launched weapon 10, for example a torpedo (as illustrated) or a guided missile for propulsion in the air above the sea surface, is housed within an inner elongate watertight container 11 which is within an outer container 12. The weapon 10 is an intelligent hunter weapon containing target homing means or a controlled guidance system is housed within container 11. The illustrated weapon comprises a forebody 13 containing a warhead and the guidance and control means and an afterbody 14 carrying propulsion means; in the embodiment illustrated, the torpedo has conventional propellers.

The outer container 12 is of elongate form and generally of cylindrical section. The container 12 is buried or partially buried within the sea bed 16 and, for this purpose, has self-burying means comprising firstly a centrifugal pump 20 for removing sand or silt from under the bottom end of the container, secondly a spiral or helical agitator/auger 21 for loosening the material on the sea bed and thirdly a high pressure pump 22 for pumping sea water to nozzles 25 disposed around the periphery of the lower end of the container 12 and for loosening sand or silt under the container. The centrifugal pump 20 is driven by an electric drive motor 24 through a gear train 23, the motor being powered by batteries 26. This pump 20 sucks up sand and silt from the sea bed, as indicated by chain lines 27, and forces it radially outwardly to the lower end of an annular region 28 between the inner and outer containers 11, 12. The sand and silt is forced upwardly through this annular region to be expelled, as indicated by arrows 29 at the upper end of the assembly. In the embodiment illustrated the agitator/auger 21 is driven from the drive shaft of pump 21*a*. This shaft also drives the high pressure pump 22.

The weapon system with its container is laid in position by dropping it into the sea and it is so constructed that, when released in water, it sinks, vertically orientated, with the heavier end at which the self-burying means 22, 21 is located lowermost and the exit end of the container 11 uppermost so that the end carrying the self-burying means settles into the sea bed first. Operation of the drive motor 24 driving pumps 20, 22 and agitator/auger 21 forces sand or silt or the like in the sea bed away from underneath the container thereby causing the container to be buried in a substantially upright position. Normally the container would be substantially wholly buried to minimise the risk of detection of the weapon system by underwater search equipment. Sand or silt may get washed over the container by the sea, with the result that the container may be completely covered.

Control of the self-burial may be effected using appropriate sensors. A first sensor to detect contact with the sea bed is indicated diagramatically at 38 and a second sensor to detect burial to the required depth is indicated at 39.

Within the container 12 is a control system indicated diagrammatically at 30 with communication equipment indicated at 31 arranged for receiving signals, e.g. acoustic signals, but possibly low frequency radio signals, from a distant control station. The communication equipment has a retractable sonar transducer and/or radio antenna 32 extending through a detachable cover 33. The communication system may be a two-way communication system if the weapon system contains a sensor or sensors for obtaining information about potential targets for transmission to the control station.

In some cases however the weapon system may be completely self-contained. In this case, an acoustic listening device may be provided as the retractable sensor 32 for detecting potential targets, the control system 30 being arranged to actuate the weapon system on reception of signals of a predetermined nature. The listening device may be part of the equipment on the weapon for weapon guidance and control.

In the particular embodiment illustrated in FIG. 1, the weapon 10 fits sufficiently closely within the inner container 11 that it can be forced out through the top of the container by gas pressure from a pressurised gas container 35 in the lower part of the inner container 11. The gas is released by a signal from the aforementioned control system 30 via transmission lines indicated at 36. Instead of a pressurised gas container, the gas may be generated, for example, chemically, e.g. by mixing of suitable chemical reactants or by firing of an explosive charge. Ejection of the weapon in this way breaks away the cover 33 which joins a watertight seal across the top of the inner container 11 and forces the weapon through any sand or silt over the top of the container. The propulsion system of the weapon 10 is actuated automatically by a signal from the control system 30 or by means responsive to the ejection of the weapon from the container so that the weapon is then propelled through the water by its propulsion system. The equipment above the weapon, e.g. cover 33 and units 30, 31 drop away and the weapon is free to move driven by its own propulsion system and guided by its own guidance system.

Instead of using pressurised gas for the ejection of the weapon, it would alternatively be possible to utilize, for example output from pump 22 to eject the weapon.

It will be noted that the arrangements described above obviate any need to raise the container out of the sea bed before launching the weapon from the container.

Figure 2:
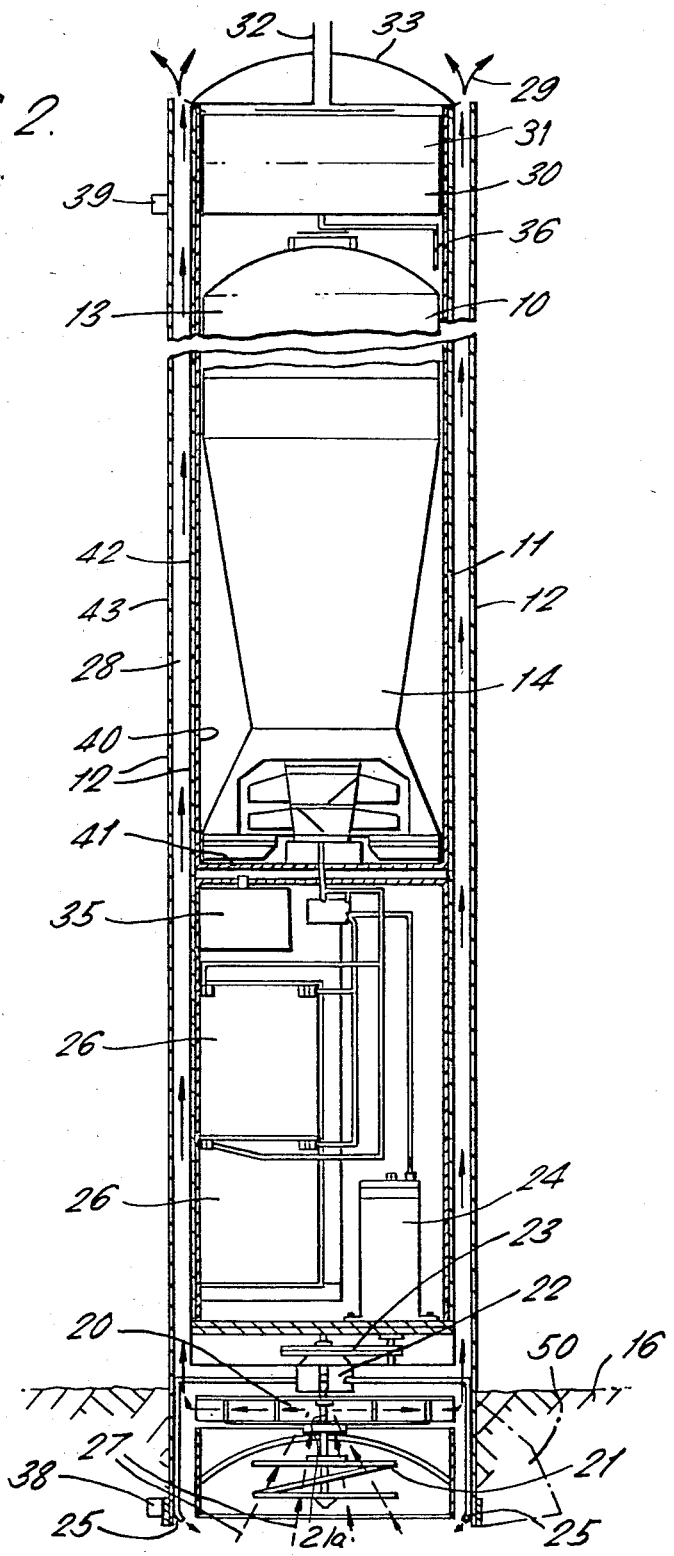
FIG. 2 illustrates a modification of the arrangement of FIG. 1.

An alternative construction is illustrated in FIG. 2, which is a modification of the construction of FIG. 1. The same reference numerals are used to indicate corresponding components and reference will be made only to the distinctive features of FIG. 2. In FIG. 2, the inner container 11 has an upper portion 40 which is telescopically slidable within the outer container 12. In the particular construction illustrated, the annular region 28 is formed by inner and outer cylindrical walls of outer container 12 but might be replaced by, for example, a plurality of ducts arranged around the outside of container 12. The lower end of the portion 40 of container 11 is closed by a closure plate 41 which, in effect, forms a piston onto which gas or hydrostatic pressure may be applied, e.g. from pressurised gas source 35 or pump 22, to force the portion 40 of the inner container upwardly. It may be completely ejected from the outer container 12 or only partially ejected, in either case leaving the weapon free to continue outwardly. The cover 33, in this case is fixed to and seals the outer container 12 but is broken away on ejection of the portion 40 of the inner container.

The rotary material displacing means 21 may be of various different constructions and the choice may depend on the type of sea bed. For fine sand or silt, the requirement is primarily to stir the material so that it is in suspension in the water and will be carried away in the water stream by the pump 20. In such an arrangement the rotary devices may have blades made of flexible or partly flexible material to enable them, when rotating, to deform over objects which might initially halt or slow down the rotary head. It will be appreciated that an obstruction, which might initially be immovable when first encountered, may well become loosened by the action of the rotary device and the water flow from the pumps. Particulate material around the object or broken off the object will be removed thereby loosening the object in the sea bed.

Sand or silt or other fine particulate material covers large areas of the sea bed. There are regions where the bed is harder, e.g. shingle or compacted silt, and it may be preferable to form the rotary device as an auger for making a hole in the sea bed.

After burial, sand or silt may get washed over the container by the sea with the result that the container may be completely covered even although initially it is only partly buried.

Various blade forms may be used. In one construction, the auger has a hollow shaft 21*a* with a helical scroll-form blade 21. High pressure gas or water is forced down through the hollow shaft to openings at the bottom end of the shaft to assist in loosening material around the tip of the shaft and to help carry material out sideways from the auger. It may be beneficial to eject pulses of highly compressed air mixed with a water jet in order to loosen any compacted silt which might tend to build up.

If a single rotating head is used, as shown in FIGS. 1 and 2, the torque generated will tend to rotate the weapon system about its own axis. This may be countered by the provision of fins, such as are shown in chain lines at 50, which may lie in radial planes with respect to the longitudinal axis of the system and are located on the outer container.

We claim:

1. An underwater weapon system comprising a self-propelled weapon, an elongate enclosure for the weapon, the weapon having first and second opposite ends, a center of gravity disposed between said ends and a center of buoyancy disposed between said ends, the center of buoyancy being located between the center of gravity and said first end of the weapon whereby the weapon sinks in seawater with said first end uppermost and said second end lowermost, the weapon enclosure at said second end having rotary material displacing means thereon for cutting into and displacing material on the sea bed from beneath the container to allow the weapon to sink into the sea bed, the enclosure for the weapon comprising an outer elongate container and an inner water-tight container disposed within the outer container and containing the weapon and further comprising ejection means for causing the weapon to break out from the enclosure through the sea bed overlying the enclosure to activate the weapon.

2. A system as claimed in claim 1 wherein the rotary material displacing means comprises at least one auger on one end of the container and operable to bore downwardly into the sea bed to form a hole into which the container enters.

3. A weapon system as claimed in claim 1 wherein the rotary displacing means is an agitator for loosening or breaking up the sea bed.

4. A weapon system as claimed in claim 1 and having pump means to pump material from the sea bed upwardly from underneath the container.

5. A weapon system as claimed in claim 1 and fins on said container adapted to enter the sea bed to prevent or reduce rotation of the container.

6. An underwater weapon system as claimed in claim 1, wherein a first sensor means is provided to detect the contact of said second end of the weapon with the sea bed to activate the material displacing means to allow the weapon to sink into the sea bed and second sensor means are provided on the weapon to detect burial to the required depth in the sea bed to de-activate the material displacing means.

7. A system as claimed in claim 1 wherein the ejection means comprises gas operated means.

8. A system as claimed in claim 7 wherein the gas operated means uses pressurised gas from a pressurised or liquefied gas store.

9. A system as claimed in claim 7 wherein the gas operated means uses gas from chemical generating means.

* * * * *